US005191851A

United States Patent [19]

Rutgerson

[11] Patent Number: 5,191,851

[45] Date of Patent: Mar. 9, 1993

[54] ARRANGEMENT FOR SAILS

[75] Inventor: Göran Rutgerson, Marstrand, Sweden

[73] Assignee: Rutgerson Marin AB, Sweden

[21] Appl. No.: 674,352

[22] PCT Filed: Oct. 21, 1988

[86] PCT No.: PCT/SE88/00556

§ 371 Date: Apr. 2, 1991

§ 102(e) Date: Apr. 2, 1991

[87] PCT Pub. No.: WO90/04539

PCT Pub. Date: May 3, 1990

[51] Int. Cl.[5] ..... B63H 9/08

[52] U.S. Cl. ..... 114/102; 114/108; 114/112

[58] Field of Search ..... 114/102, 103, 108, 112

[56] References Cited

U.S. PATENT DOCUMENTS 1,695,674 12/1928 Wilson ..... 114/112
1,829,413 10/1931 Kozlay ..... 114/112
4,649,848 3/1987 Belvedere ..... 114/103
4,823,720 4/1989 Foster ..... 114/103 X

*Primary Examiner*—Sherman Basinger
*Attorney, Agent, or Firm*—Lerner, David, Littenberg, Krumholz & Mentlik

[57] ABSTRACT

An apparatus for securing battens mounted on a sail and for adjusting the tension of the battens is disclosed, the apparatus having track slide members which are slidably connected for movement along a mast, a fitting device is used to connect the sail to respective track slide members and to secure a respective batten in a predetermined position on the sail so that a portion of the device is fixed in the lateral direction with respect to a respective track slide member when the sail is forced toward the mast, and the same portion of the fitting device is free to move in all directions with respect to the respective track slide member when the sail is forced away from the mast. Additionally, the battens are mounted and secured along the sail so that the tension can be simply and effectively adjusted.

7 Claims, 3 Drawing Sheets

ARRANGEMENT FOR SAILS

BACKGROUND OF THE INVENTION

The present invention relates to an arrangement for those sails which are provided with battens in accordance with what is stated in the preamble of Patent claim 1. It relates in particular to those battens which are found on the mainsail of a Bermuda rig, i.e. in the most common rig type in sailing boats for leisure use and regatta purposes.

In the said type, battens, i.e. rods inserted in pockets in the sail, are used to increase the rigidity of the sail and to prevent it from flapping. A more advanced use is the use of the battens to control the bellying of the sail by means of the battens being tensioned so that they bend and create a belly in the sail which can be controlled by means of this tensioning and permits an increase in its degree of efficiency in certain winds. For this to be achieved, the battens must extend across the whole width of the sail, so-called full-battening, and one end of the batten must have a fixed support while the other end rests against a displaceable support, so that the degree of tensioning of the batten can be varied.

SUMMARY AND OBJECTS OF THE INVENTION

Arrangements are previously known by means of which a batten can be given different degrees of tensioning. Certain arrangements are relatively primitive and use cords or ropes but do not have actual fittings, for which reason they are difficult to handle and are timeconsuming, and their securing function is of limited reliability. In other known arrangements there is a fitting, but this is attached separately to the sail, and its function is therefore dependent on the movements of the canvas, which results in less satisfactory control of the securing of the batten. In addition, known arrangements are often designed in such a way that the securing arrangement for the batten is located on the rear edge of the sail, which makes access difficult, and the arrangement can moreover catch in the stay and shroud.

The aim of the present invention is to provide an arrangement for securing a batten, which arrangement is situated close to the mast and is satisfactorily controlled by means of the latter and can, in addition, be combined with those arrangements for securing of the sail which are necessary in any case.

Another aim is to provide an arrangement which secures the batten very reliably and permits a rapid and reliable tensioning of the latter in the desired position.

A further aim is to provide an arrangement which does not interfere with the other rig functions, but permits an unimpeded hoisting and lowering of the sail and the necessary movement of the latter.

DESCRIPTION OF THE DRAWINGS

An embodiment of the arrangement is shown in the attached drawings.

DETAILED DESCRIPTION

Figure 1:
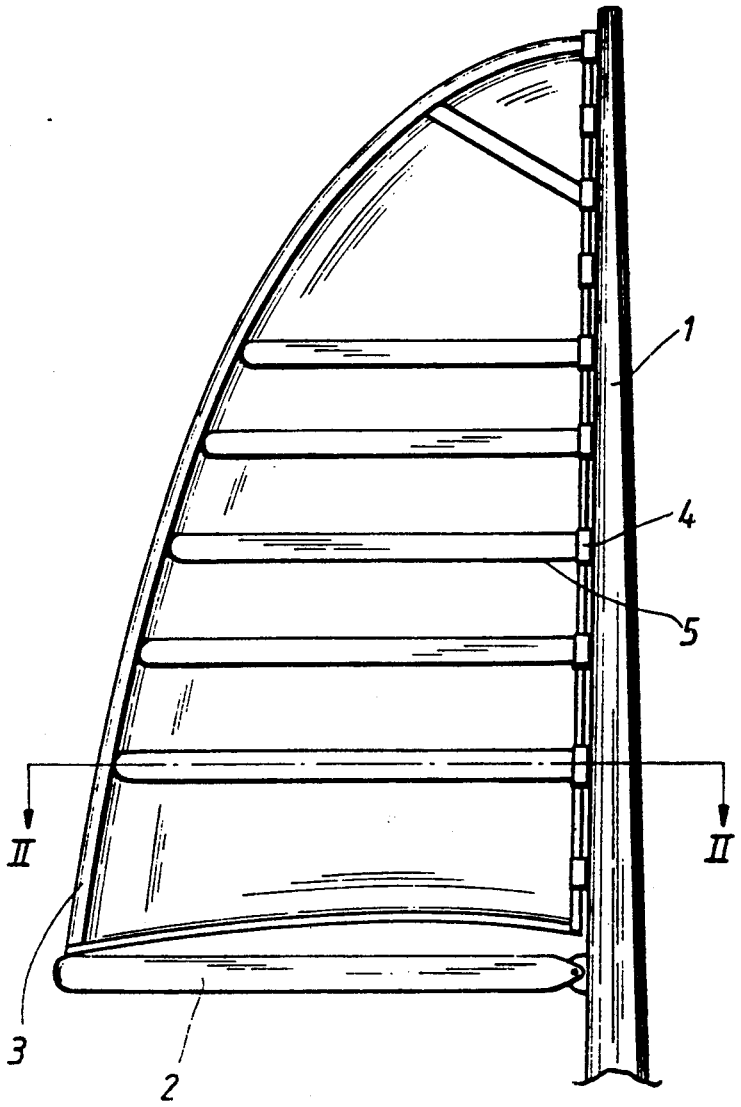
FIG. 1 shows a diagrammatic side view of a mainsail in a Bermuda rig, which sail is provided with battens which are intended to be secured with the aid of the arrangement according to the invention.

FIG. 1 shows a mast 1 with a boom 2 and a sail 3. The sail is connected to the mast by means of a number of track slides 4 which run in a groove in the mast and permit hoisting and reefing of the sail. Running across the sail from its fore edge close to the mast to its free aft edge are a number of pockets 5 which enclose battens, that is to say rods of a hard, resilient material such as reinforced plastic. These battens are designated by 6 in the following figures.

Figure 2:
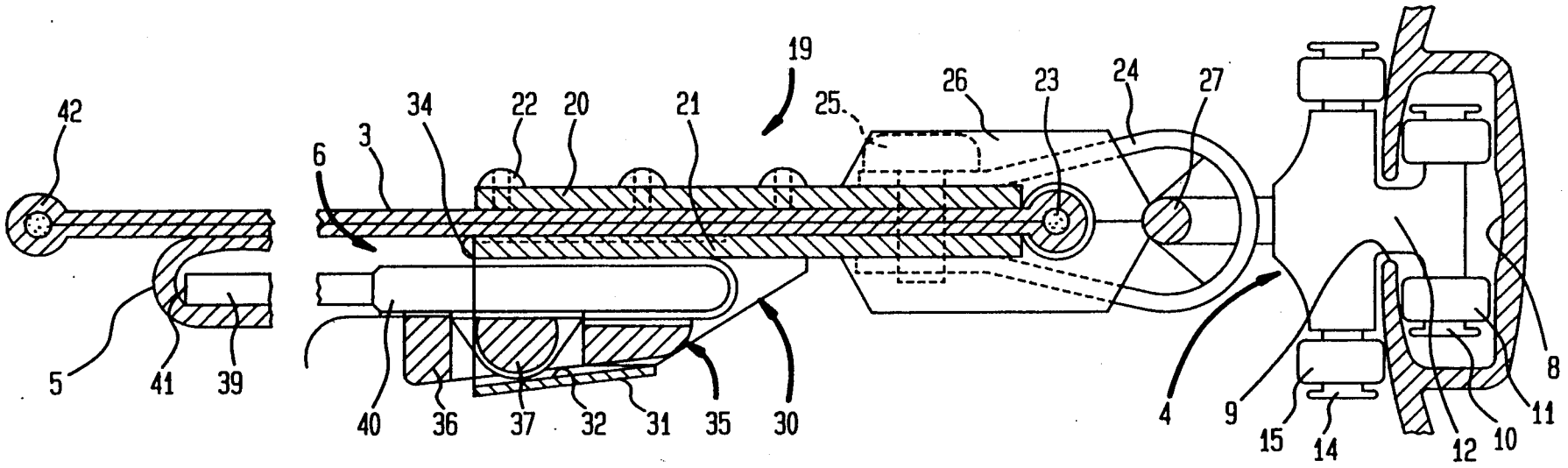
FIG. 2 shows, on an enlarged scale, a cutaway of the arrangement according to the invention in a section designated II—II in FIG. 1.
Figure 3:
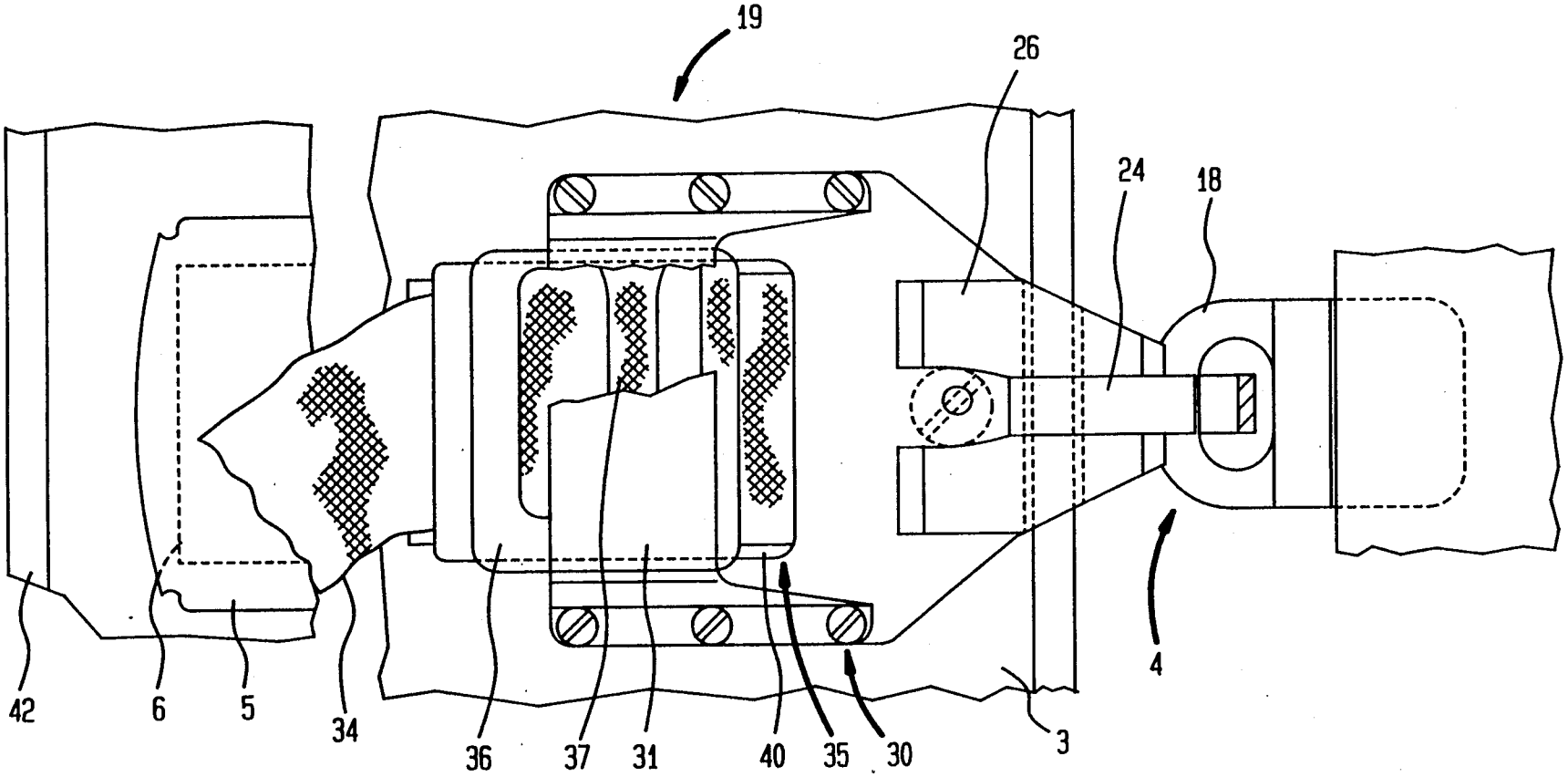
FIG. 3 shows a side view of the arrangement on the same scale as the cutaway in FIG. 2 and seen in the same viewing direction as in FIG. 1.

According to FIG. 1 the battens 6 start from a number of track slides 4 which are specially designed for connection to those ends of the battens facing towards the mast, in the manner which emerges from the following description. In the cutaway in FIG. 2, the mast 1 is shown in section. It is assumed to be made of extruded light metal and has a groove 8 with an opening 9 which is directed outwards towards the rear edge of the mast, where the track slides 4 are situated. One such track slide 4 is also shown in FIG. 2. The track slide extends into the groove 8 through the opening 9 and has pegs 10 on which rollers 11 are rotatably arranged. According to FIG. 3 the pegs 10 and, therefore, the rollers 11 too can be four in number, by which means the track slide inside the groove 8 acquires an extensive support in two directions.

An intermediate part 12 of the track slide extends out through the opening 9 and merges into an outer widened part 13, itself also provided with pegs, here designated 14. Rotatable rollers 15 are arranged on the pegs and bear against the outside of the mast. These pegs and rollers can also be four in number, as emerges from FIG. 3. At the outermost point the track slide has an eye 18.

The sail 3 is supported by the track slide by means of a fitting 19. The latter comprises two plates 20 and 21 which are clamped together around the canvas by means of retention members, here a screw union 22 consisting of six screws with nuts. At its edge facing towards the mast, the sail is finished with a bolt rope 23 surrounding a line, and the plates 20, 21 finish before the bolt rope. A loop 24 extends out from the edge of the sail and in through the eye 18 of the track slide, this loop being secured by means of a member 25, here a screw, which extends through the loop and the plates 20, 21 and is threaded in the one leg of the loop.

The loop 24 secures a support member 26 in the form of two shoulders, preferably of hard plastic, which bear against the plates 20, 21 and surround the bolt rope 23 and have outer support surfaces 27, which are arranged to bear against the eye 18 of the track slide.

A hasp 30 is secured on the outside of the plate 21 by means of the screws 22 extending through it. The hasp is open at both ends and has a connecting part 31 which extends parallel to that edge of the sail facing towards the mast. The part 31 has a stop face 32, which is inclined in such a way that there is formed, between it and the outside of the plate 21, a wedge-shaped space which widens in the direction away from that edge of the sail facing towards the mast.

With the aid of the plate 21, a cord 34 is secured in front of the said space between the plate and the surface 32. For attachment to the cord, a clamping element 35 is arranged, which is designed as a wedge-shaped buckle. The clamping element 35 has an outer frame 36 and, in its middle part, a beam 37, by means of which two elongate openings are formed through which the cord 34 can be threaded. The clamping element is to be positioned in the space of the hasp 30 (its part 31 is partially cut away in FIG. 3 in order to show the clamping element).

As has been mentioned, the batten 6 consists of an elongate rod and has a main part 39 and a somewhat widened head 40. The batten, like the sail, is cut away in FIGS. 2 and 3 for reasons of space. However, it emerges that the batten 6 has an aft end 41 which is situated at the aft edge of the sail, which, like the fore edge, is provided with a bolt rope 42. As can also be seen, the batten 6 is inserted in the said pocket 5 on the sail. Such a pocket is formed by a strip of canvas being sewn on the sail. Its end close to the bolt rope 42 is closed, as can be seen from FIG. 2, by virtue of the fact that the end of the canvas strip has been turned in and sewn on. The end 41 of the batten can therefore bear against this turned-in and sewn-on part of the pocket. In contrast, the fore end of the pocket facing towards the mast is open and allows the batten to be pushed into the pocket.

When the batten is inserted in the pocket, it is situated inside the hasp 30. The cord 34 will then extend from the edge of the plate 21 towards the near edge of the sail and, thereafter, about the rounded end of the head 40 of the batten, under the frame 36 of the clamping element 35, through its one opening over the beam 37, so that is passes the latter on the side where the surface 32 is situated, in through the next opening and passing the frame on the side facing towards the batten.

When the arrangement has been fitted in the manner shown in the figures, the batten can be secured relative to the sail by means of the clamping element 35 being pushed into the hasp 30 in such a way that, as a result of the wedge effect, it is pressed against the head 40 of the batten and in turn presses the latter against the plate 21. The clamping element 35 is pushed in while pulling on the cord, by which means the latter is drawn tight about the rounded end of the batten.

Thus, the batten is clamped securely at its head 40, on the one hand, between the clamping element 35 bearing against the hasp 30 and the plate 21 and, on the other hand, at the same time its end bears against the loop of the cord. By pulling on the cord 34 with a certain force while the clamping element is being pushed into the hasp, the end of the batten can be pressed backwards to a greater or lesser extent and, thus, the batten can be tensioned tightly to a greater or lesser extent while bearing against the closed, aft end of the pocket 5. At a certain force the batten will bend, and how great this bending is will be determined by the force to which the batten is subjected. In this way the bellying of the sail, because the latter follows the bending of the batten, can be controlled in a simple manner by pulling on the cord 34 while at the same time pressing the clamping element 35 into the securing position when the desired tensioning of the batten has been obtained.

The arrangement has many advantages. It provides very good control of the sail at the edge facing towards the mast. The sail is often subjected to forward-directed forces, and these are absorbed by the surfaces 27 of the shoulders 26, which surfaces bear against the eye 18 of the track slide 4 held very firmly in the mast.

For its part, the track slide is designed, by means of the rollers 10 and 15, in such a way that it can run easily along the mast regardless of the direction in which the sail seeks to force it. The securing of the sail by means of the eye 18 of the track slide and the loop 24 of the fitting 19 permits, in addition to pivoting in the horizontal plane, also different angles in the vertical plane between the fitting 19 and the track slide 4 and, thus, also different angles between the batten and the edge of the sail; c.f. the inclined top batten in the sail shown in FIG. 1. When striking the sail, the angle between the edge of the sail and the batten relative to the track slide may alter as a result of the sail hanging down, but this is permitted by the securing arrangement without any breaks occurring. When the sail is not raised and stretched, the degree of freedom is so great that, as they reach the boom 2 during striking of the sail, the battens can lay on their side so that they are stacked onto each other to the least possible height.

In summary, the arrangement according to the invention provides for such a suspension of the sail with its battens that it is held flat, which is the precondition for satisfactory efficiency. When the sail is raised, it attempts, as a result of its suspension in one edge at the mast, to press this edge inwards towards the mast and, if this force is not absorbed and the sail can slide on the side of the mast, then the result of this is that the sail can belly between the battens if the latter are not centred to the mast. This is achieved, as previously described, by means of the fact that the blocks on the sail fitting 19 are caught and centred by the eye of the track slide. Despite this control in the lateral direction, the necessary pivoting of the sail about the mast is not prevented, since the eyes have a circular cross-section.

When the sail is lowered, the forward-directed force ceases and the fitting is no longer controlled by the track slides by means of the blocks being caught by the eyes, as a result of which the said freedom of movement in more planes than the horizontal plane arises.

By virture of the fact that the securing fixture for the battens is positioned close to the mast and is well connected to the track slides, advantageous conditions for handling are achieved. During tensioning, the mast constitutes an abutment and it is not necessary to carry out any work on the outer edge of the sail, which is of course intended to swing together with the boom. At the aft edge of the sail, no fittings are required, as a result of which, on the one hand, the sail is simpler to produce and, on the other hand, it is possible to omit rigid parts which can strike against or catch in other parts of the rig.

The embodiment described constitutes only one example, and the invention can be given various embodiments within the scope of the following patent claims. Thus, it is not necessary for the fitting to comprise two plates, one on each side of the sail, but instead the plates can be replaced by articles formed in another way, such as frames, strips or the like, on both sides or one side of the sail. The principle of using the wedge effect for creating a pressure against the end of the batten for purposes of securing it can be replaced by other suitable principles, such as securing by means of an eccentric, by means of pressure from a screw connection, for example, without departing from the inventive concept, to the extend that such a design falls within the patent claims.

The arrangement according to the invention has been described in conjunction with full-battened sails with battens which extend across the whole width of the sail. Of course, the arrangement can also be used with shorter battens where a securing in the manner indicated here is desired.

I claim:

1. Apparatus for supporting a sail including batten means on a mast comprising track slide means moveably slideable along said mast, fitting means for coupling said track slide means to said sail and for securing said batten means in a predetermined position on said sail, said fitting means including first eye means having an outer surface, said first eye means being affixed to said track slide means, and second eye means affixed to said fitting means, said first and second eye means being interlocking, said second eye means including a support surface having a predetermined configuration corresponding to said outer surface of said first eye means, whereby when said sail is urged in a first direction away from said mast, said first and second eye means engage each other so as to provide for mutual freedom of movement therebetween, and when said sail is urged in a second direction towards said mast said support surface of said second eye means engages said outer surface of said first eye means so as to limit lateral displacement therebetween.

2. The apparatus of claim 1 wherein said batten means comprises a flexible material having a first end and a second end, and including restraining means for mounting said second end of said batten means at a fixed location on said sail.

3. The apparatus of claim 2 wherein said fitting means includes adjustable securing means for adjustably securing said first end of said batten means at an adjustable location relative to said mast so as to provide a predetermined degree of tension in said batten means.

4. The apparatus of claim 1 wherein said fitting means comprises a pair of parallel plates clamped on either side of said sail.

5. Apparatus for supporting a sail including batten means on a mast comprising track slide means moveably slideable along said mast, said batten means comprising longitudinally extending flexible material having a first end and a second end, fitting means for coupling said track slide means to said sail and for detachably securing said first end of said batten means on said sail, and restraining means for mounting said second end of said batten means at a fixed location on said sail, said fitting means including adjustable securing means for passing about and bearing against said first end of said batten means so as to secure said first end of said batten means at an adjustable location relative to said mast so that said first end of said batten means is secured at predetermined locations relative to said mast so as to alter the distance between said first end of said batten means and said mast and provide a predetermined degree of tension in said batten means.

6. Apparatus for supporting a sail including batten means on a mast comprising track slide means moveably slidable along said mast, said batten means comprising longitudinally extending flexible material having a first end and second end, fitting means for coupling said track slide means to said sail and for detachably securing said first end of said batten means on said sail, and restraining means for mounting said second end of said batten means at a fixed location on said sail, said fitting means including adjustable securing means for adjustably securing said first end of said batten means at an adjustable location relative to said mast so as to provide a predetermined degree of tension in said batten means, said adjustable securing means including hasp means mounted at a fixed location with respect to said sail, and wedge means mountable on said first end of said batten means, said wedge means being adjustably mountable within said hasp for adjustably mounting said first end of said batten means with respect to said hasp means.

7. The apparatus of claim 6 including cord means having a first end and a second end, said first end of said cord means being mountable at a fixed location with respect to said sail, and said second end of said cord means being threadable through said wedge means for adjustably fixing said first end of said batten means with respect to said hasp means.

* * * * *

UNITED STATES PATENT AND TRADEMARK OFFICE

CERTIFICATE OF CORRECTION

PATENT NO. : 5,191,851

DATED : March 9, 1993

INVENTOR(S) : Rutgerson

It is certified that error appears in the above-identified patent and that said Letters Patent is hereby corrected as shown below:

Column 1, delete lines 26-27.
Column 1, line 34, "timeconsuming" should read --time-consuming--.
Column 1, line 44, insert the heading --SUMMARY AND OBJECTS OF THE INVENTION--.
Column 4, line 63, "extend" should read --extent--.

Signed and Sealed this

Thirtieth Day of November, 1993

Bruce Lehman

*Attest:*

BRUCE LEHMAN

*Attesting Officer*

*Commissioner of Patents and Trademarks*